US011705669B2

(12) United States Patent
Fan et al.

(10) Patent No.: US 11,705,669 B2
(45) Date of Patent: Jul. 18, 2023

(54) HIGH-CURRENT HIGH-FREQUENCY ELECTRICAL CONNECTOR RECEPTACLE APPLICABLE TO NETWORK DATA TRANSMISSION

(71) Applicant: Goldenconn Electronic Technology Co., Ltd, Suzhou (CN)

(72) Inventors: Guangcai Fan, Suzhou (CN); Song Zou, Suzhou (CN); Zhigang He, Suzhou (CN)

(73) Assignee: Goldenconn Electronic Technology Co., Ltd, Suzhou (CN)

( * ) Notice: Subject to any disclaimer, the term of this patent is extended or adjusted under 35 U.S.C. 154(b) by 70 days.

(21) Appl. No.: 17/375,733

(22) Filed: Jul. 14, 2021

(65) Prior Publication Data

US 2022/0271475 A1 Aug. 25, 2022

(30) Foreign Application Priority Data

Feb. 20, 2021 (CN) ..... 202110191614.2

(51) Int. Cl.
*H01R 13/6461* (2011.01)
*H01R 13/64* (2006.01)
(Continued)

(52) U.S. Cl.
CPC ..... *H01R 13/64* (2013.01); *H01R 13/502* (2013.01); *H01R 13/516* (2013.01); *H01R 13/639* (2013.01); *H01R 13/6461* (2013.01)

(58) Field of Classification Search
CPC .... H01R 13/64; H01R 13/502; H01R 13/516; H01R 13/639; H01R 13/6461
See application file for complete search history.

(56) References Cited

U.S. PATENT DOCUMENTS 7,556,531 B2 * 7/2009 Takeuuchi ..... H01R 13/6594 439/607.01
8,011,959 B1 * 9/2011 Tsai ..... H01R 13/6461 439/607.25

(Continued)

FOREIGN PATENT DOCUMENTS

EP 3790127 3/2021

OTHER PUBLICATIONS

IEEE Std 802.3™, IEEE Standard for Information Technology, Published by The Institute of Electrical and Electronics Engineers, Inc., 8 Park Avenue, New York, NY 10016-05997, USA, Mar. 8, 2002.

(Continued)

*Primary Examiner* — Thanh Tam T Le
(74) *Attorney, Agent, or Firm* — David R. Stevens; Stevens Law Group

(57) ABSTRACT

A high-current high-frequency electrical connector receptacle applicable to network data transmission includes a receptacle housing and a socket tongue. The socket tongue is inserted into the receptacle housing in a front-rear direction, and a relative position thereof is locked. The socket tongue includes an upper terminal block, a lower terminal block and an insulating plastic body. The upper terminal block and the lower terminal block are both built in and fixed into the insulating plastic body. The receptacle housing is provided with a special-shaped fool-proofing unit.

10 Claims, 17 Drawing Sheets

(51) Int. Cl.

| | |
|---|---|
| ***H01R 13/502*** | (2006.01) |
| ***H01R 13/516*** | (2006.01) |
| ***H01R 13/639*** | (2006.01) |

(56) References Cited

U.S. PATENT DOCUMENTS

| | | | | |
|---|---|---|---|---|
| 8,016,620 | B1 * | 9/2011 | Chiu | H01R 13/6594 439/660 |
| 8,535,097 | B2 * | 9/2013 | Yen | H01R 13/6594 439/607.4 |
| 8,668,527 | B2 * | 3/2014 | Zhang | H01R 13/6594 439/660 |
| 9,088,108 | B2 * | 7/2015 | Zhao | H01R 13/6581 |
| 9,318,854 | B2 * | 4/2016 | Chang | H01R 13/6594 |
| 9,768,560 | B2 * | 9/2017 | Yao | H01R 13/405 |
| 9,847,604 | B2 * | 12/2017 | Guo | H01R 13/405 |
| 9,912,106 | B2 * | 3/2018 | Yao | H01R 13/501 |
| 9,985,393 | B2 * | 5/2018 | Zhao | H01R 24/60 |
| 10,027,063 | B2 * | 7/2018 | Peng | H01R 12/594 |
| 10,153,566 | B2 * | 12/2018 | Zhang | H01R 13/6658 |
| 10,164,791 | B2 * | 12/2018 | Wang | H01R 13/6594 |
| 10,199,776 | B2 * | 2/2019 | Cheng | H01R 24/60 |
| 10,236,632 | B2 * | 3/2019 | Zhang | H01R 24/60 |
| 10,270,211 | B2 * | 4/2019 | Yu | H01R 13/6473 |
| 10,271,349 | B2 * | 4/2019 | Lee | H04L 12/18 |
| 10,468,831 | B2 * | 11/2019 | Zhao | H01R 24/62 |
| 10,566,743 | B2 * | 2/2020 | Zhao | H01R 13/6594 |
| 10,833,454 | B2 * | 11/2020 | Zhao | H01R 13/6582 |
| 10,910,759 | B2 * | 2/2021 | Naito | H01R 13/516 |

OTHER PUBLICATIONS

Ethernet RJ45 Color Code with Pinout (T568A, T568B) https://www.etechnophiles.com/ri45-color-code-pinout/, Jan. 19, 2023.

Universal Serial Bus Type-C Connectors and Cable Assemblies Compliance Document, Revision 2.0, Apr. 29, 2020.

* cited by examiner

56V--->1.25~2A (PIN A1-A8)
0 V--->1.25~2A (PIN B5-B8)

56V--->1.25~2A (PIN A1-A8)
0 V--->1.25~2A (PIN B5-B8)

| TYPE X | IL(dB) | NEXT(dB) | FEXT(dB) | RL(dB) |
|---|---|---|---|---|
| CAT 5E | >-0.2dB @20MHz,<br>>-0.4dB @100MHz, | <-54dB @20MHz,<br><-43dB @100MHz, | <-35.1dB @100MHz, | <-34dB @20MHz,<br><-20dB @100MHz, |
| Result | PASS | PASS | PASS | PASS |

Material Properties

- Housing (LCP, $\varepsilon_r$=3.4, dtan=0.02)
- PCB (FR4, $\varepsilon_r$=4.2, dtan=0.02)

| TYPE X | IL(dB) | VSWR | Impedance(Ω) | RL(dB) |
|---|---|---|---|---|
| SPEC Speed=15Gbps | >-10dB @15GHz. | NA | 50Ω Tr≤50ps(10%-90%) | NA |
| Result | PASS | NA | NA | NA |

HIGH-CURRENT HIGH-FREQUENCY ELECTRICAL CONNECTOR RECEPTACLE APPLICABLE TO NETWORK DATA TRANSMISSION

CROSS-REFERENCE TO RELATED APPLICATIONS

This application is based on and claims the benefit of priority from Chinese Patent Application No. 202110191614.2, filed on 20 Feb. 2021, the entirety of which is incorporated by reference herein.

TECHNICAL FIELD

The present disclosure relates to the field of electrical connector manufacturing technologies, and in particular, to a high-current high-frequency electrical connector receptacle applicable to network data transmission.

BACKGROUND

Currently, with the rapid development of information industry and the continuous progress of electronic technology, more and more terminal devices are deployed over a network, applied in quite different scenarios and deployed at different time, and therefore a Power over Ethernet (PoE) switch is the best choice to remotely supply power to the devices. PoE refers to a technology that can provide DC power for some IP-based terminals (e.g., an IP phone, a wireless local network access point (AP), a network camera and a network TV base station for communication) while transmitting high-speed data signals without any changes to the existing Ethernet Cat.5 wiring infrastructure. The PoE technology may ensure the security of existing structured wiring, ensure the normal operation of an existing network, and reduce a wiring cost to the maximum extent.

With a power requirement of a power receiving terminal, e.g., a low-power high-definition video television (70 W) and other high-definition display devices, the PoE power supply technology is required to be continuously upgraded, from the original 30 W power supply to 90 W, 100 W, or even 200 W in the future. With the arrival of 5G era, requirements on signal transmission rate and quality become higher and higher, an original Ethernet transmission interface has reached the bottleneck, and can no longer meet a growing market requirement. Therefore, an electric connector capable of implementing high-speed Ethernet transmission, high-power power supply and high-speed signal transmission is provided in view of the above. In the existing technology, the electrical connector is mainly formed by a connector receptacle and a connector plug through insertion. The connector receptacle includes a receptacle housing and a socket tongue. The socket tongue is built in and fixed in a cavity of the receptacle housing, and includes an upper terminal block, a lower terminal block and an insulating plastic body. The upper terminal block and the lower terminal block are both fixed to the insulating body and configured to transmit signals or power.

The connector plug includes a plug housing and a bayonet socket. The bayonet socket is built in and fixed in the plug housing. When the connector plug is inserted in the connector receptacle, the plug housing is sleeved with the receptacle housing. During the insertion process, the plug housing slides along the receptacle housing. Meanwhile, the socket tongue is gradually inserted into the bayonet socket.

In the existing technology, as shown in FIG. 16 and FIG. 17, both of the cross sections of the receptacle housing and the plug housing are a rounded rectangle and are not provided with misinsertion proofing marks. Thus, when multiple connectors are applied side by side at the same time, mixed insertion and misinsertion of other connector plugs into the high-current high-frequency electric connector receptacle for network data transmission occur quite easily, consequently, inevitably causing signal connection errors, and even burn-in in severe cases. Therefore, it is urgent for a skilled person to solve the above problems.

SUMMARY

Therefore, in view of the above existing problems and defects, the designer of the present disclosure collects relevant information, and finally a high-current high-frequency electric connector receptacle applicable to network data transmission is provided through continuous experiments and modifications by technicians engaged in the industry who have years of experience in research and development and through multi-party evaluation and consideration.

To solve the above technical problem described above, the present disclosure relates to a high-current high-frequency electrical connector receptacle applicable to network data transmission. The electrical connector receptacle includes: a receptacle housing, provided with a first special-shaped fool-proofing unit; and a socket tongue, configured to be inserted and locked into the receptacle housing. The socket tongue includes an upper terminal block, a lower terminal block and an insulating plastic body, and the upper terminal block and the lower terminal block are both built in and fixed into the insulating plastic body.

As a further improvement on the technical solution of the present disclosure, the first special-shaped fool-proofing unit includes a left chamfered part, and the left chamfered part is formed by chamfering of a left side wall and a top wall of the receptacle housing.

As a further improvement on the technical solution of the present disclosure, the first special-shaped fool-proofing unit further includes a right chamfered part mirrored to the left chamfered part, and the right chamfered part is formed by chamfering of a right side wall and the top wall of the receptacle housing.

As a further improvement on the technical solution of the present disclosure, a second special-shaped fool-proofing unit is disposed on the insulating plastic body.

As a further improvement on the technical solution of the present disclosure, the second special-shaped fool-proofing unit includes a left fool-proofing protruding strip and a right fool-proofing protruding strip, and the left fool-proofing protruding strip and the right fool-proofing protruding strip are both formed by extending upwardly from a top wall of the insulating plastic body.

As a further improvement on the technical solution of the present disclosure, the insulating plastic body includes a transverse limiting protruding strip formed by extending from at least one of the top wall and a bottom wall of the insulating plastic body and configured to limit a depth by which the socket tongue is inserted into the receptacle housing.

As a further improvement on the technical solution of the present disclosure, the insulating plastic body includes at least one upper anti-twist groove formed in the top wall of the insulating plastic body, and at least one lower anti-twist groove formed in the bottom wall of the insulating plastic body, and the receptacle housing includes at least one upper inwardly-concave strip formed in a top wall of the receptacle housing and inserted into the at least one upper anti-twist groove, and at least one lower inwardly-concave strip formed in a bottom wall of the receptacle housing and inserted into the at least lower anti-twist groove.

As a yet further improvement on the technical solution of the present disclosure, the at least one upper inwardly-concave strip is inserted into the at least one upper anti-twist groove in a clearance fit manner, the at least one lower inwardly-concave strip is inserted into the at least one lower anti-twist groove in a clearance fit manner, and single-side clearance is controlled in the range of 0.1 mm to 0.2 mm.

As a still further improvement on the technical solution of the present disclosure, the at least one upper inwardly-concave strip is formed by direct downward drawing from the top wall of the receptacle housing, and the at least one lower inwardly-concave strip is formed by direct upward drawing from the bottom wall of the receptacle housing.

As a yet still further improvement on the technical solution of the present disclosure, the at least one upper anti-twist groove includes two upper anti-twist grooves disposed side by side in a left-right direction, and the at least one lower anti-twist groove includes two lower anti-twist grooves disposed side by side in a left-right direction.

As a further improvement on the technical solution of the present disclosure, the socket tongue further includes a left locking plate and a right locking plate; the left locking plate and the right locking plate are both built in and fixed into the insulating plastic body; the left locking plate includes a left slot extending rightwards from a left side wall of the left locking plate, and the insulating plastic body includes a left avoidance notch disposed on a left side wall of the insulating plastic body to expose the left slot; and the right locking plate includes a right slot extending leftwards from a right side wall of the right locking plate, and the insulating plastic body includes a right avoidance notch disposed on a right side wall of the insulating plastic body to expose the right slot.

Compared with an electrical connector receptacle with a conventional design structure, in the technical solution in the present disclosure, the special-shaped fool-proofing unit is additionally disposed on the receptacle housing of the electrical connector receptacle. Accordingly, the electrical connector plug matched with the electrical connector receptacle is structurally improved to fit the special-shaped fool-proofing unit. Thus, when multiple electrical connectors are arranged side by side, conventional electrical connector plugs do not adopt an adaptive remodel design, and therefore other electrical connector plugs cannot be inserted into the high-current high-frequency electrical connector receptacle even if workers perform misoperation, thereby effectively preventing mixed insertion and misinsertion of other electrical connector plugs into the high-current high-frequency electrical connector receptacle, finally ensuring that signals are correctly transmitted and a high-power terminal device does not undergo crash and burn-in.

BRIEF DESCRIPTION OF DRAWINGS

To describe the technical solutions in the embodiments of the present disclosure or in the existing technology more clearly, the following briefly describes the accompanying drawings required for describing the embodiments or the existing technology. Apparently, the accompanying drawings in the following description show merely some embodiments of the present disclosure, and a person of ordinary skill in the art may derive other drawings from these accompanying drawings without creative efforts.

FIG. 18-1 shows a Pin definition form in a long-distance 15 G signal transmission state of a high-current high-frequency electrical connector receptacle applicable to network data transmission in a normal application state in the present disclosure;

FIG. 18-2 shows a Pin definition form in a long-distance 20 G signal transmission state of a high-current high-frequency electrical connector receptacle applicable to network data transmission in a normal application state in the present disclosure;

FIG. 19 is a summary list of an Ethernet performance test project for a high-current high-frequency electrical connector receptacle applicable to network data transmission in the present disclosure;

1: Receptacle housing; 11: first special-shaped fool-proofing unit; 111: left chamfered part; 112: right chamfered part; 12: upper inwardly-concave strip; 13: lower inwardly-concave strip; 2: socket tongue; 21: upper terminal block; 22: lower terminal block; 23: insulating plastic body; 231: second special-shaped fool-proofing unit; 2311: left fool-proofing protruding strip; 2312: right fool-proofing protruding strip; 232: transverse limiting protruding strip; 233: upper anti-twist groove; 234: lower anti-twist groove; 235: left avoidance notch; 236: right avoidance notch; 24: left locking plate; and 25: right locking plate.

DETAILED DESCRIPTION

In the description of the present disclosure, it should be understood that the orientations or positional relationships indicated by the terms "front", "rear", "up", "down", "left", "right", etc. are based on the orientations or positional relationships shown in the accompanying drawings and are merely for ease in describing the present disclosure and simplifying this description, but not to indicate or imply that an indicated device or element must have a particular orientation and be constructed and operated in a particular orientation, and thus they should not be construed as limitations on the present disclosure.

Figure 1:
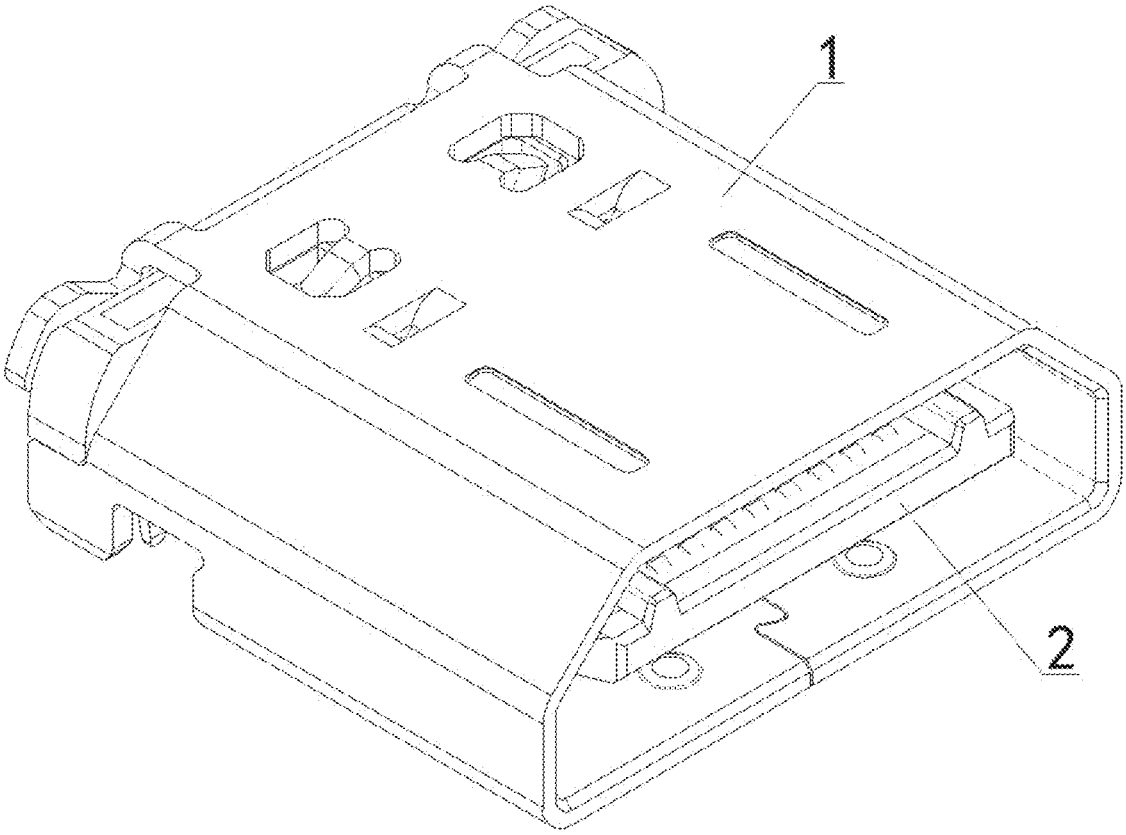
FIG. 1 is a schematic 3D view of a high-current high-frequency electrical connector receptacle applicable to network data transmission in the present disclosure.
Figure 2:
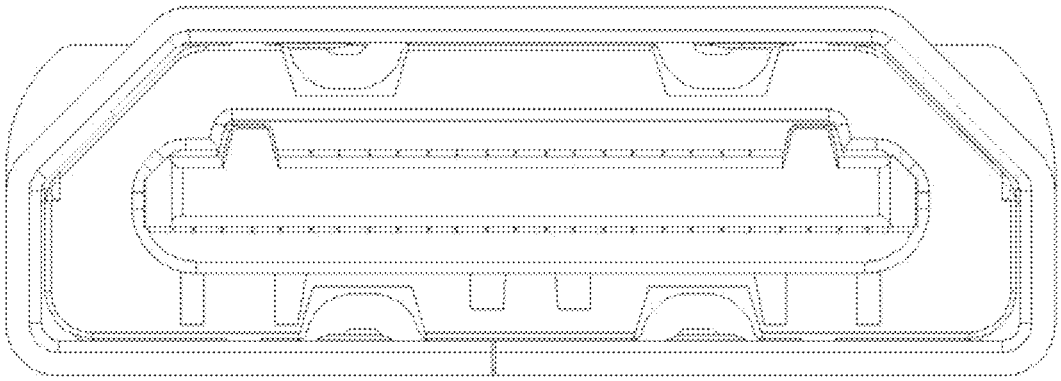
FIG. 2 is a front view of FIG. 1.
Figure 3:
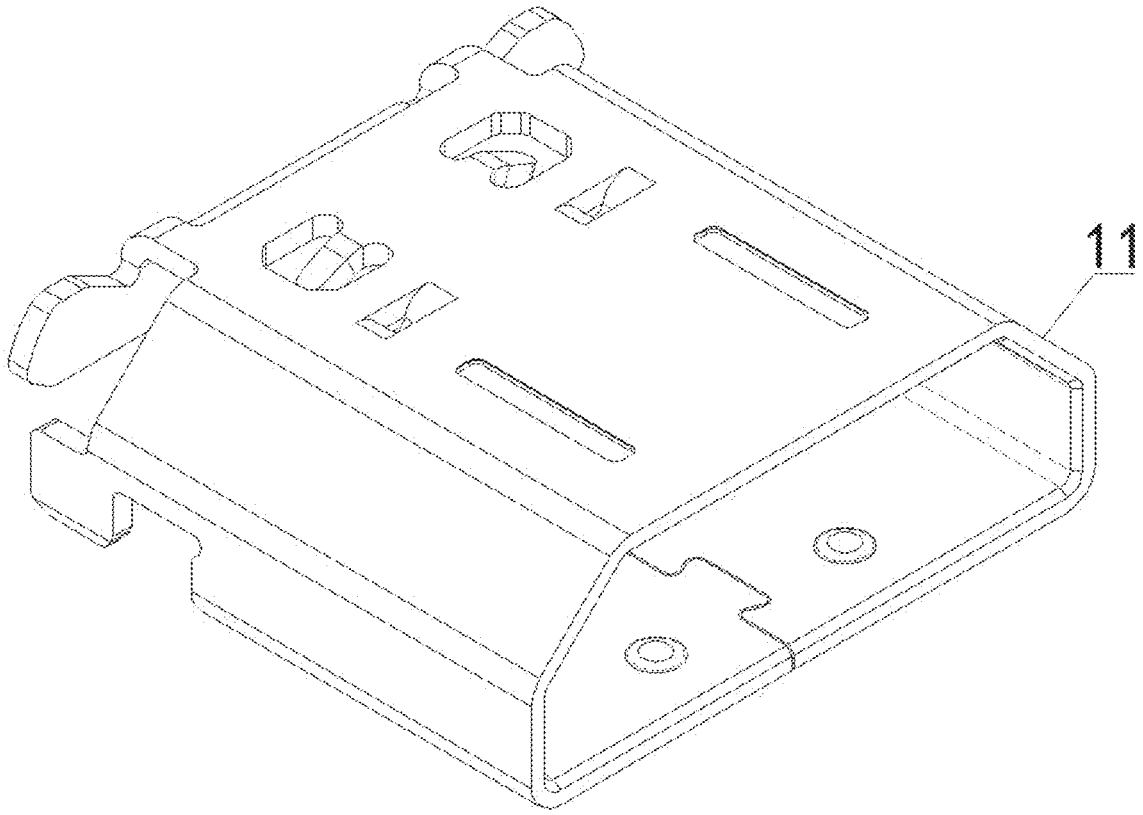
FIG. 3 is a schematic 3D view of a receptacle housing in a high-current high-frequency electrical connector receptacle applicable to network data transmission in the present disclosure.
Figure 4:
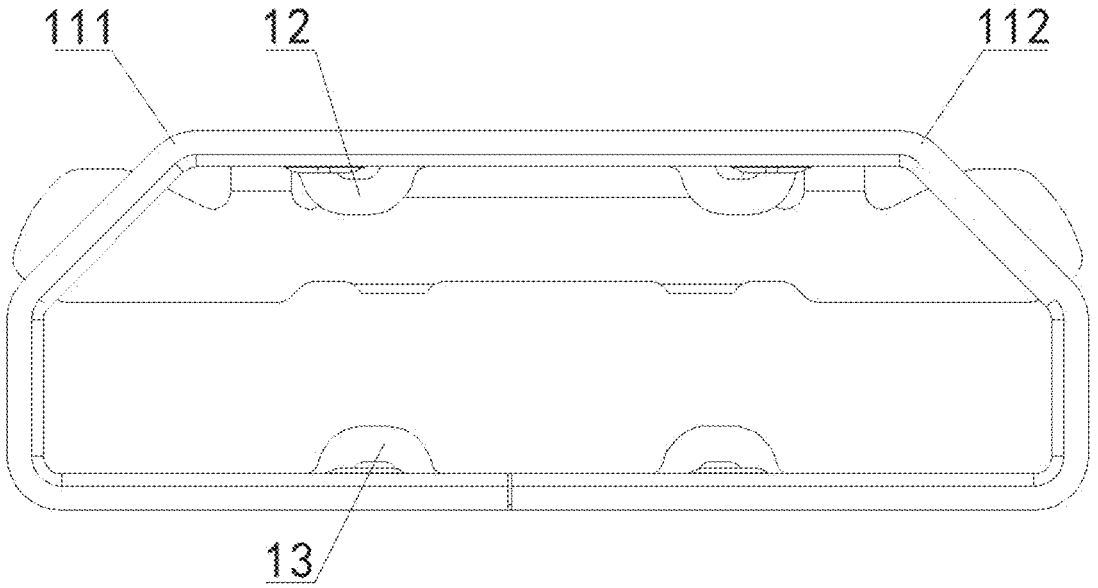
FIG. 4 is a front view of FIG. 3.
Figure 5:
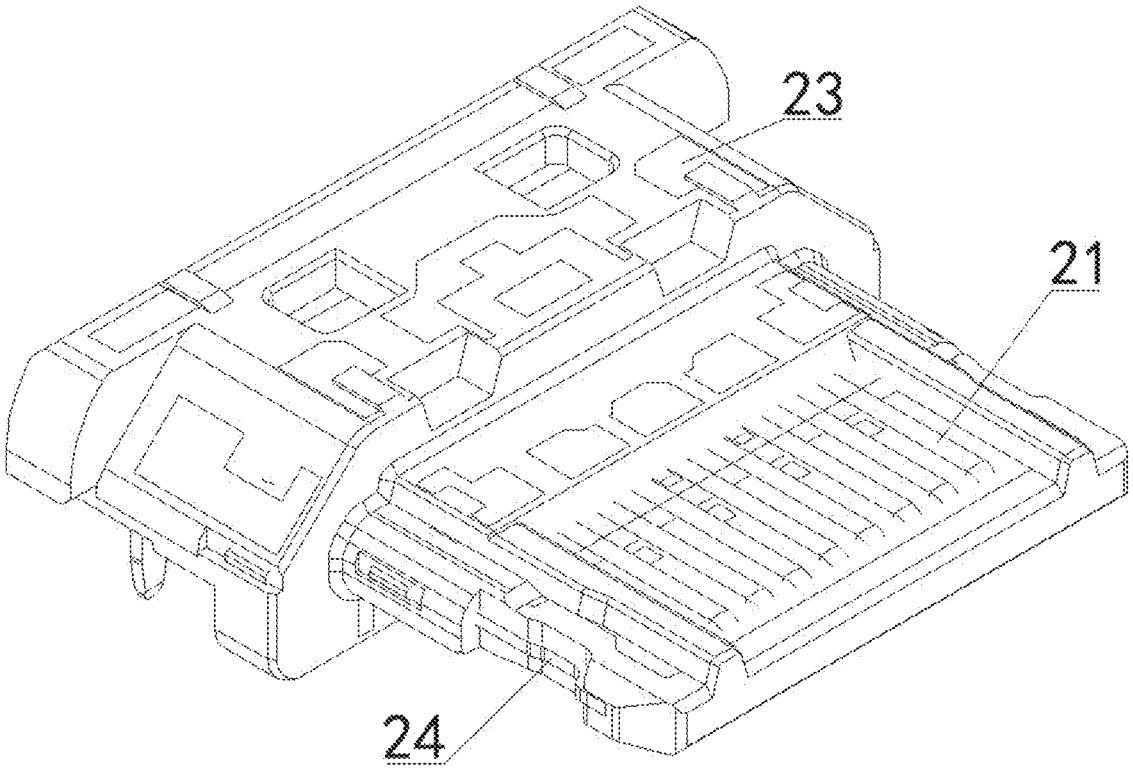
FIG. 5 is a schematic 3D view of a socket tongue in a high-current high-frequency electrical connector receptacle applicable to network data transmission in the present disclosure from one angle.
Figure 6:
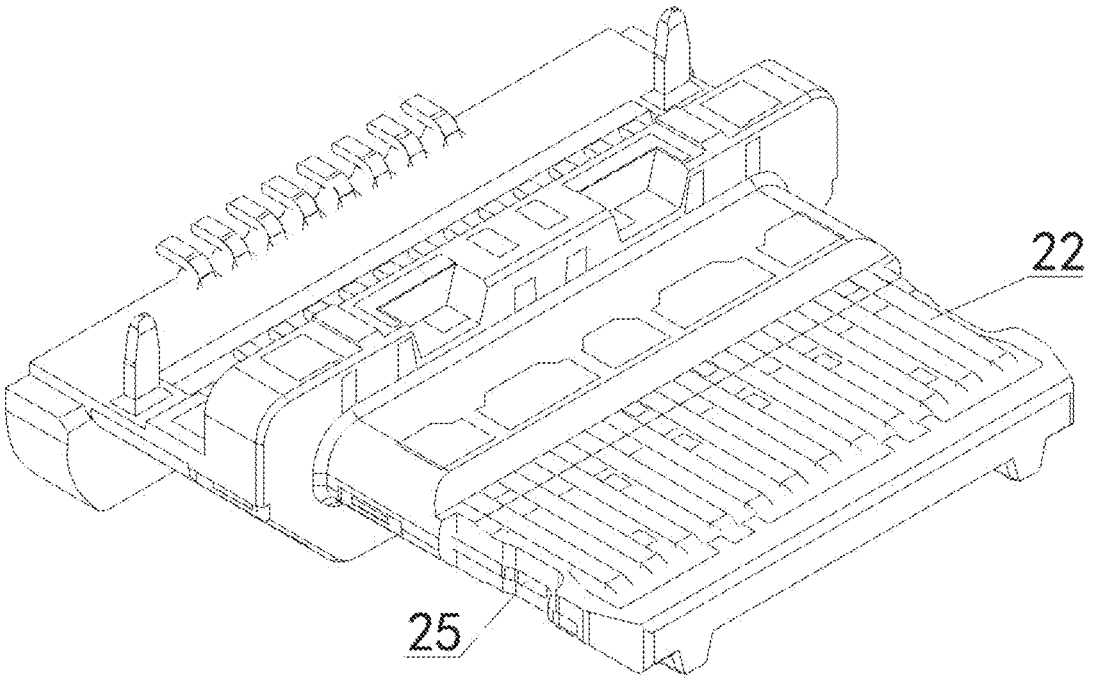
FIG. 6 is a schematic 3D view of a socket tongue in a high-current high-frequency electrical connector receptacle applicable to network data transmission in the present disclosure from another angle.
Figure 15:
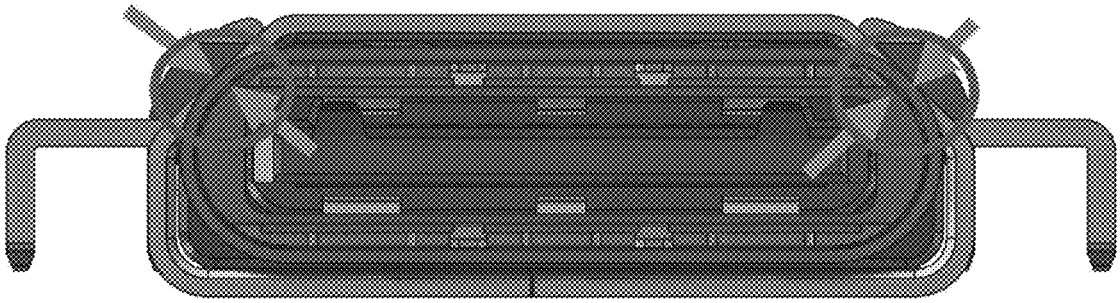
FIG. 15 is a schematic diagram illustrating an interference state in which a conventional electrical connector plug is inserted into a high-current high-frequency electrical connector receptacle applicable to network data transmission in the present disclosure.
Figure 16:
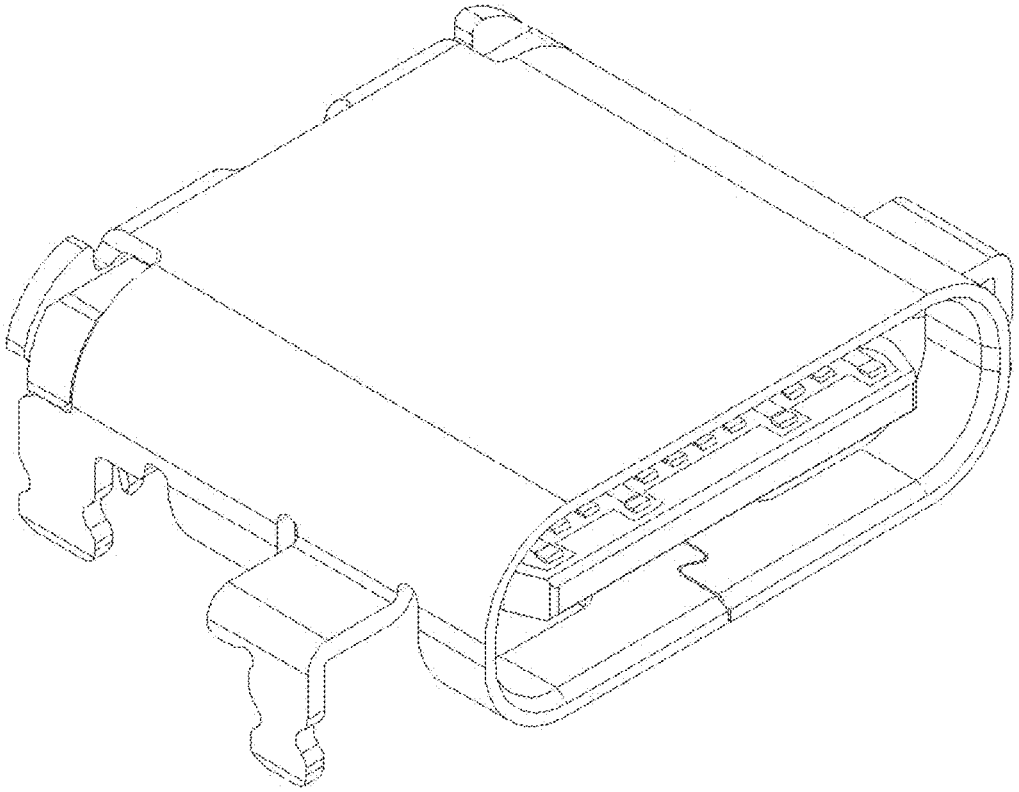
FIG. 16 is a schematic 3D view of a conventional electrical connector receptacle in the existing technology.
Figure 17:
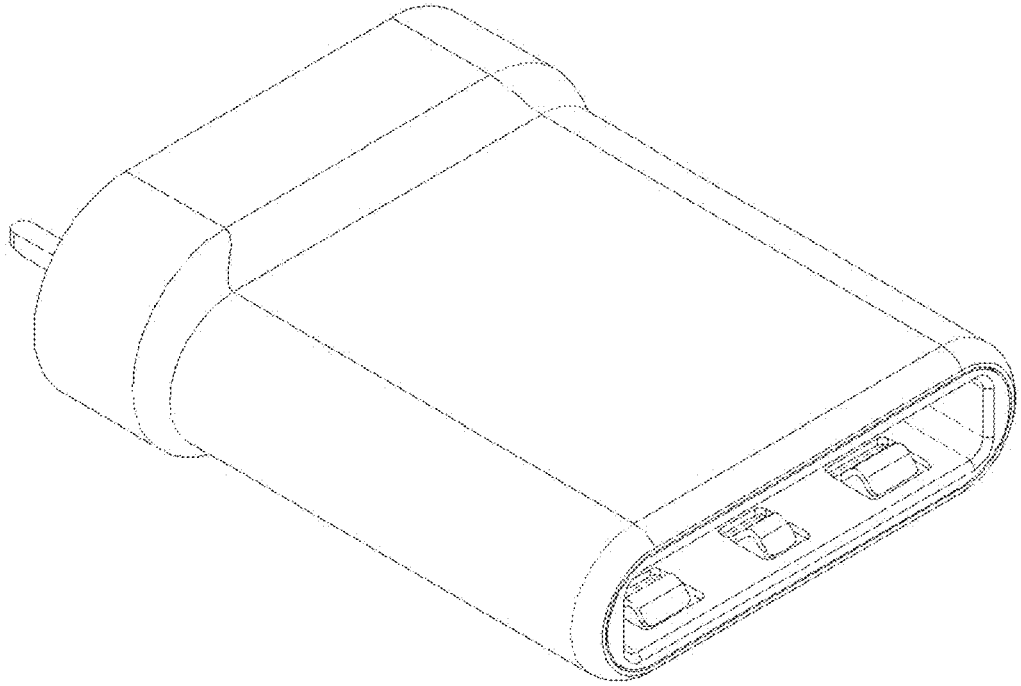
FIG. 17 is a schematic 3D view of a conventional electrical connector plug in the existing technology.

The following further describes the content of the present disclosure in detail in conjunction with the specific embodiments. FIG. 1 and FIG. 2 show a schematic 3D view and a front view of a high-current high-frequency electrical connector receptacle applicable to network data transmission in the present disclosure respectively. It can be learned that the electrical connector receptacle mainly includes a receptacle housing 1, a socket tongue 2, etc. The socket tongue 2 is inserted into the receptacle housing 1 in a front-rear direction, and a relative position thereof is locked. As shown in FIG. 5 and FIG. 6, the socket tongue 2 includes an upper terminal block 21, a lower terminal block 22 and an insulating plastic body 23. The upper terminal block 21 and the lower terminal block 22 are both built in and fixed into the insulating plastic body 23. To ensure fool-proofing performance, as shown in FIG. 3 and FIG. 4, the receptacle housing 1 is further provided with a first special-shaped fool-proofing unit 11, which is specifically embodied in that: the receptacle housing 1 is provided with a left chamfered part 111. The left chamfered part 111 is formed by chamfering of a left side wall and a top wall of the receptacle housing 1. During the manufacturing and forming process of an electrical connector, an electrical connector plug inserted into the electrical connector receptacle further needs to be adaptively structurally changed. Thus, an insertion part of the receptacle housing 1 adopts a special-shaped design so as not to be matched with conventional plugs. When multiple electrical connectors are arranged side by side, conventional electrical connector plugs do not adopt an adaptive remodel design, and therefore workers certainly fail to insert other conventional plugs into the electrical connector receptacle after remodel design due to interference even in case of misoperation (as shown in FIG. 15), thereby effectively preventing mixed insertion and misinsertion of other connector plugs into the electrical connector receptacle, finally ensuring that signals are correctly transmitted and a high-power terminal device does not undergo crash and burn-in.

As a further optimization on the high-current high-frequency electrical connector receptacle applicable to network data transmission, the first special-shaped fool-proofing unit 11 further includes a right chamfered part 112. The right chamfered part 112 is mirrored to the left chamfered part 111 and is formed by chamfering of a right side wall and the top wall of the receptacle housing 1 (as shown in FIG. 3 and FIG. 4). The left chamfered part 111 and the right chamfered part 112 are applied in a matching manner, and therefore a fool-proofing function of the electrical connector receptacle can be further improved, and misinsertion is avoided.

Figure 7:
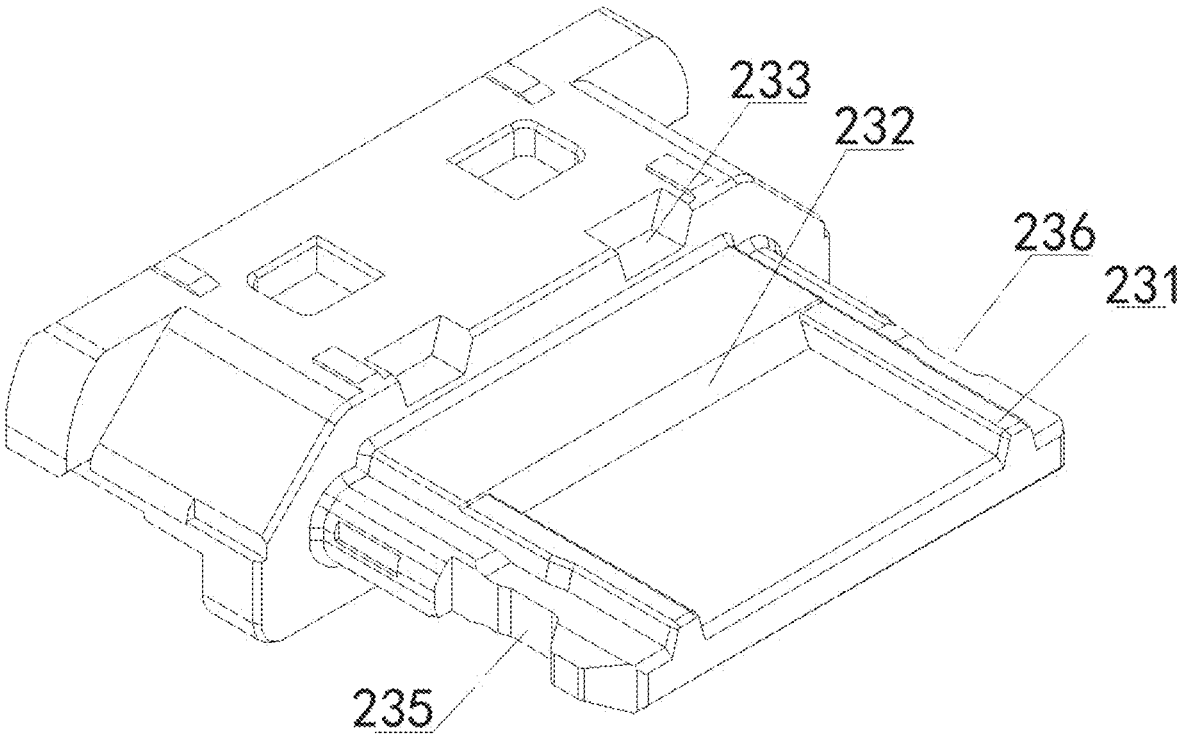
FIG. 7 is a schematic 3D view of an insulating plastic body in a high-current high-frequency electrical connector receptacle applicable to network data transmission in the present disclosure from one angle.
Figure 8:
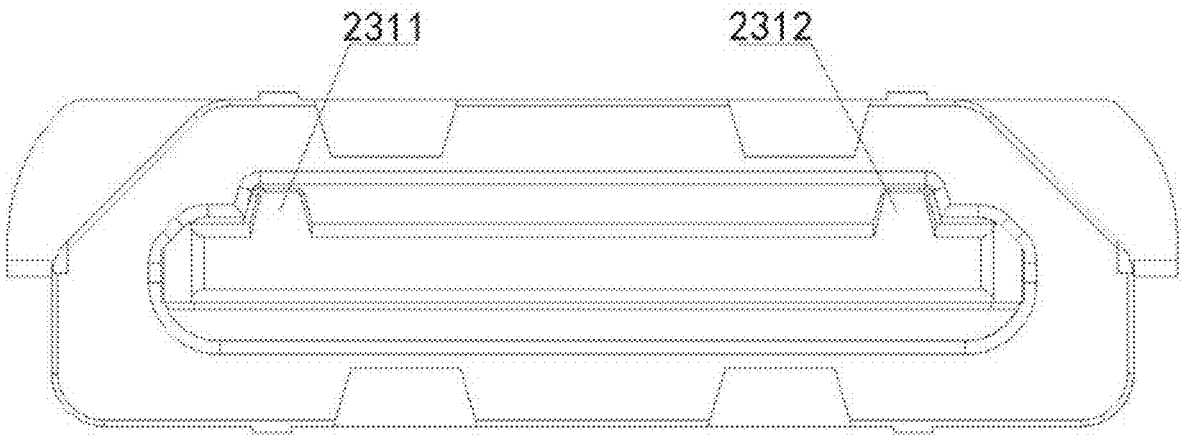
FIG. 8 is a front view of FIG. 7.
Figure 9:
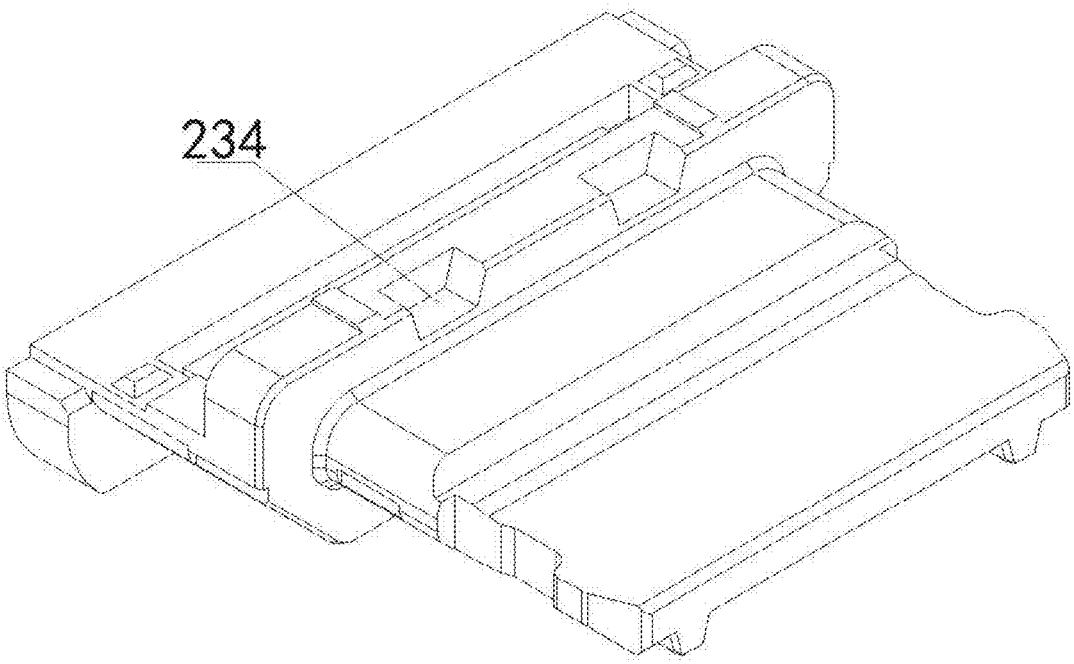
FIG. 9 is a schematic 3D view of an insulating plastic body in a high-current high-frequency electrical connector receptacle applicable to network data transmission in the present disclosure from another angle.

In the above technical solution, only the receptacle housing 1 adopts a remodel design, and therefore insertion of conventional electrical connector plugs of the same specification can be effectively avoided. However, entries of conventional electrical connector plugs of a smaller specification may not be avoided because a plug housing may directly pass by the left chamfered part 111 or/and right chamfered part 112 and directly enter the receptacle housing 1. In view of this, to further improve fool-proofing performance of the electrical connector receptacle, a second special-shaped fool-proofing unit 231 may further be disposed on the insulating plastic body 23. As shown in FIG. 7 and FIG. 8, the second special-shaped fool-proofing unit 231 includes a left fool-proofing protruding strip 2311 and a right fool-proofing protruding strip 2312. The left fool-proofing protruding strip 2311 and the right fool-proofing protruding strip 2312 are both formed by extending upwardly from a top wall of the insulating plastic body 23 and are disposed side by side in a left-right direction. Accordingly, a left avoidance groove and a right avoidance groove (not shown in figures) matched with the left fool-proofing protruding strip 2311 and the right fool-proofing protruding strip 2312 are formed in an insulating plastic body of the electrical connector plug. Thus, an insulating plastic body of a conventional electrical connector plug is not provided with avoidance grooves, so that when misinsertion occurs, even if the plug housing can enter the receptacle housing 1, insertion fails because the left fool-proofing protruding strip 2311 and the right fool-proofing protruding strip 2312 may be interfered with by the insulating plastic body of the conventional electrical connector plug.

Figure 13:
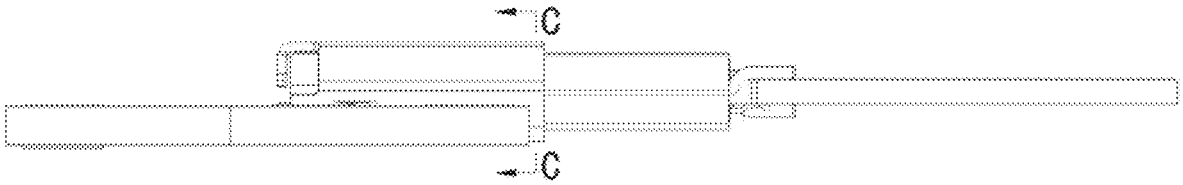
FIG. 13 is a schematic diagram illustrating a state in which a high-current high-frequency electrical connector receptacle applicable to network data transmission is inserted into an electrical connector plug matched with the electrical connector receptacle in the present disclosure.
Figure 14:
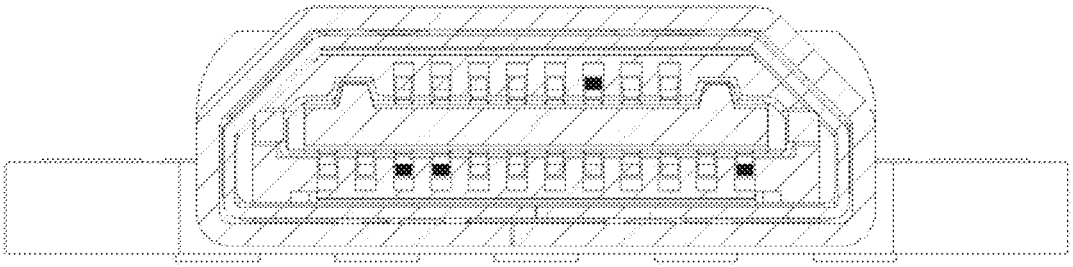
FIG. 14 is a sectional view along a line C-C in FIG. 13.

It should be noted that an electrical connector plug needs to be adaptively structurally improved to be correctly inserted into the electrical connector receptacle in the present disclosure. Specifically, the electrical connector plug housing needs to be chamfered to be matched with the left chamfered part 111 and the right chamfered part 112; and accordingly avoidance grooves further need to be formed in a bayonet socket of the electrical connector plug to be matched with the left fool-proofing protruding strip 2311 and the right fool-proofing protruding strip 2312 (as shown in FIG. 13 and FIG. 14).

To control the insertion depth of the electrical connector plug into the electrical connector receptacle and prevent excessive insertion so as to ensure the correct matching relationship between receptacle terminals and plug terminals, a transverse limiting protruding strip 232 may further be formed by extending from the top wall or/and a bottom wall of the insulating plastic body 23. The transverse limiting protruding strip 232 extends in a width direction of the insulating plastic body 23 (as shown in FIG. 7, FIG. 9, FIG. 10 and FIG. 12).

It is learned that when insertion of the electrical connector plug into the electrical connector receptacle is completed, the socket tongue 2 may inevitably be extremely prone to twisting relatively to the receptacle housing 1 under the action of external force, finally affecting signal transmission stability. In view of this, to ensure the reliable and stable assembly relationship between the receptacle housing 1 and the socket tongue 2, at least one upper anti-twist groove 233 may further extend downwardly from the top wall of the insulating plastic body 23, and accordingly upper inwardly-concave strips 12 inserted into the upper anti-twist grooves 233 are disposed on the top wall of the receptacle housing 1. At least one lower anti-twist groove 234 may extend upwardly from the bottom wall of the insulating plastic body 23, and accordingly lower inwardly-concave strips 13 inserted into the lower anti-twist grooves 234 are disposed on a bottom wall of the receptacle housing 1 (as shown in FIG. 3, FIG. 4, FIG. 7, FIG. 8, FIG. 9, FIG. 10, FIG. 11 and FIG. 12).

Figure 10:
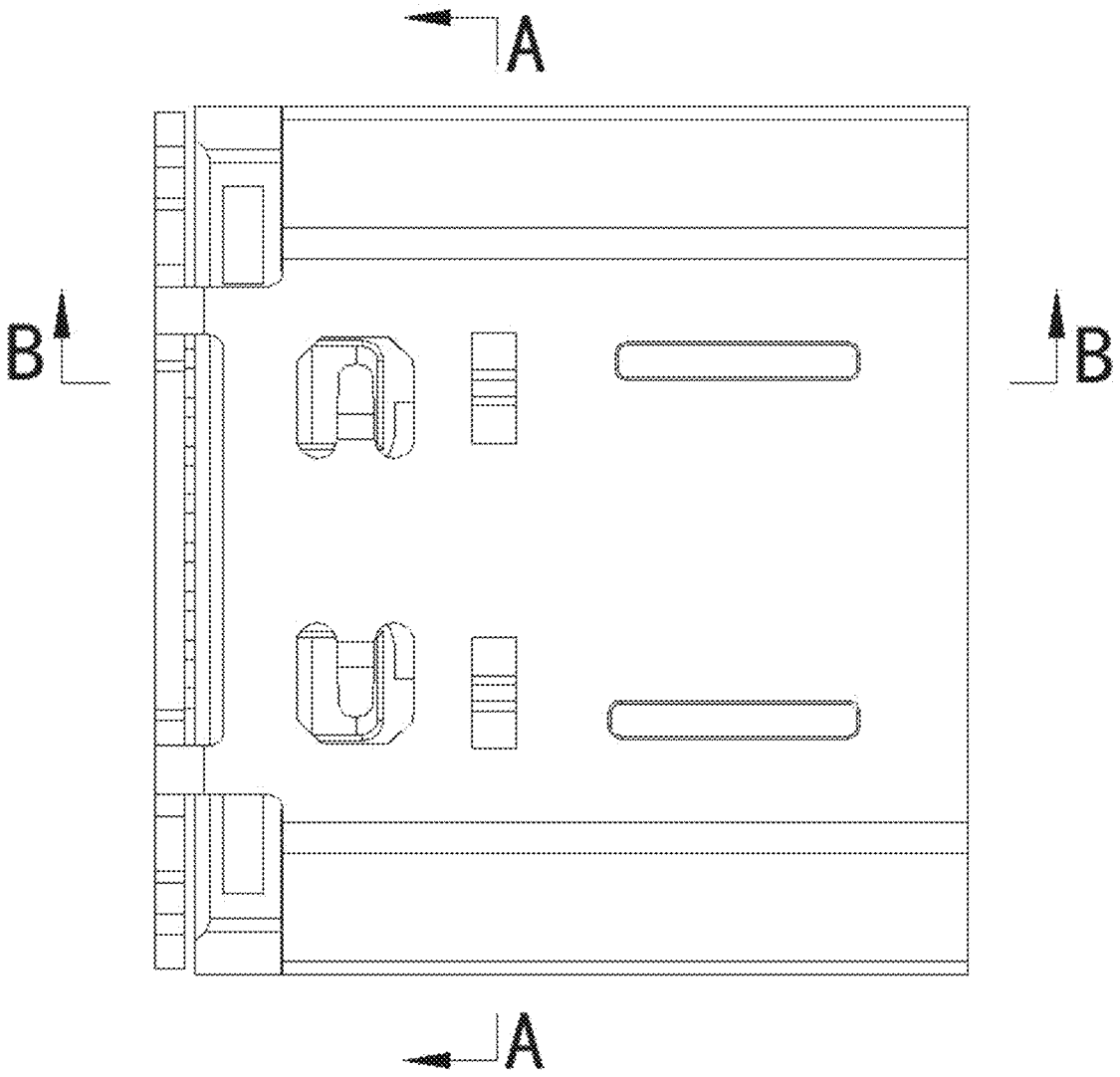
FIG. 10 is a top view of FIG. 1.
Figure 11:
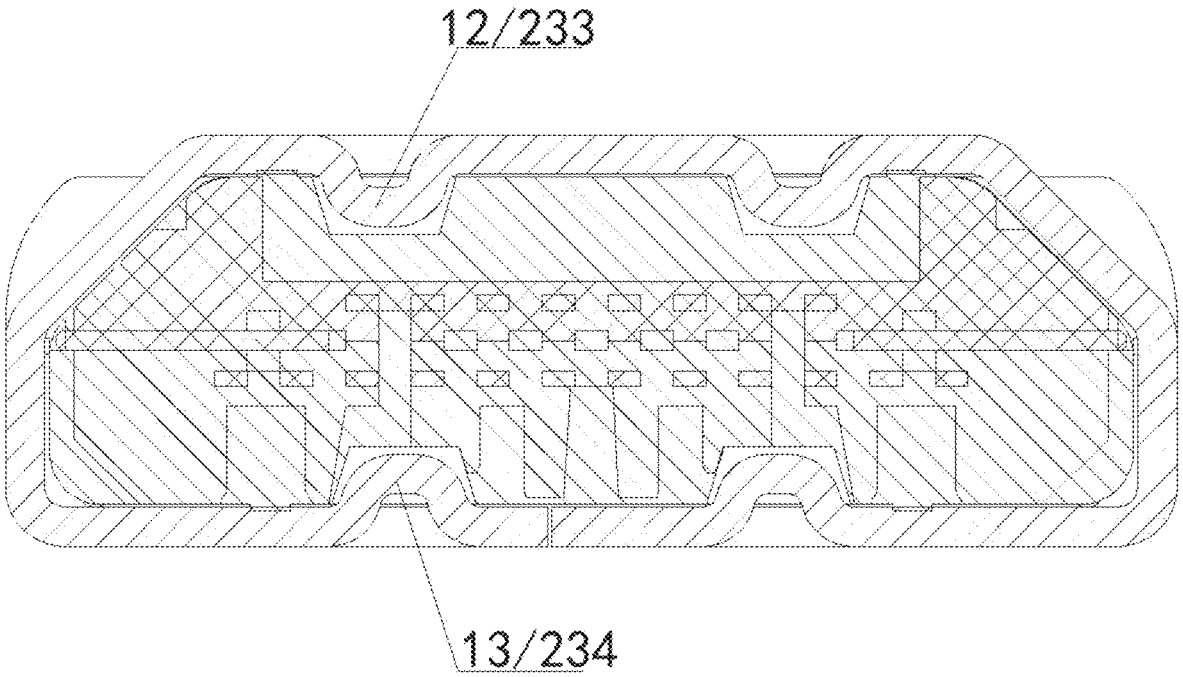
FIG. 11 is a sectional view along a line A-A in FIG. 10.
Figure 12:
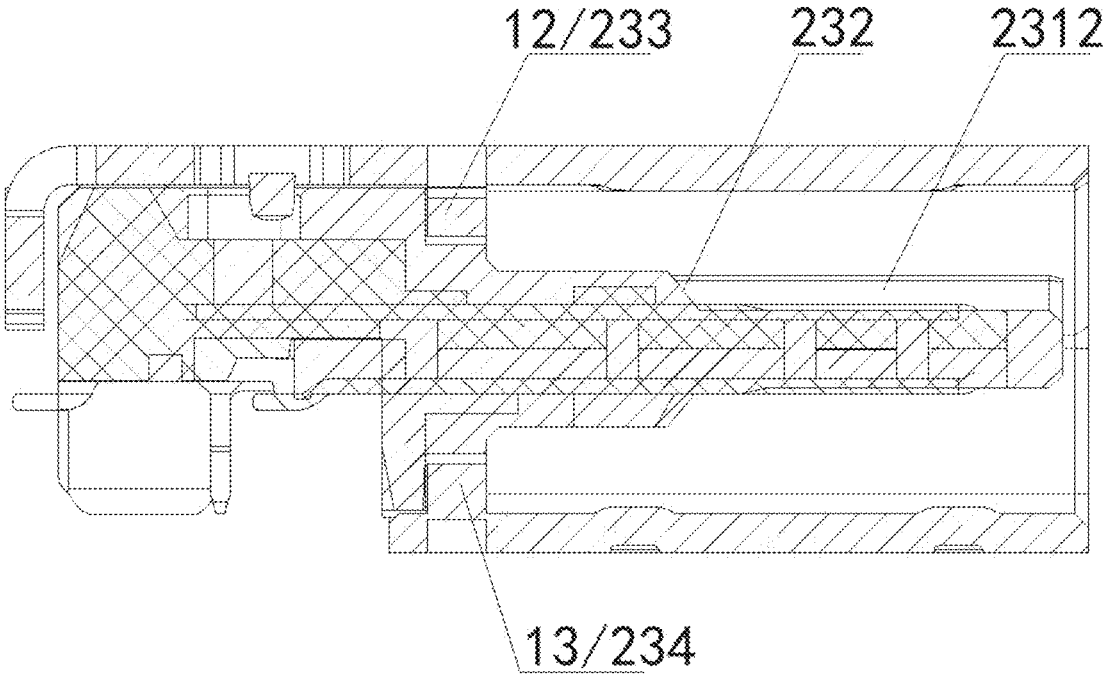
FIG. 12 is a sectional view along a line B-B in FIG. 10.

In general, the upper inwardly-concave strips 12 are inserted into the upper anti-twist grooves 233 in a clearance fit manner, the lower inwardly-concave strips 13 are inserted into the lower anti-twist grooves 234 in a clearance fit manner, and single-side clearance is controlled in the range of 0.1 mm to 0.2 mm (as shown in FIG. 10 and FIG. 11). On the premise of ensuring a good use function of the electrical connector receptacle, by controlling assembly clearance, assembly difficulty of the electrical connector receptacle can be effectively lowered, and assembly efficiency is improved.

As shown in FIG. 3 and FIG. 4, it can be learned that, preferably, the upper inwardly-concave strips 12 are both formed by direct downward drawing from the top wall of the receptacle housing 1. Preferably, the lower inwardly-concave strips 13 are both formed by direct upward drawing from the bottom wall of the receptacle housing 1. This not only effectively lowers forming difficulty of the upper inwardly-concave strips 12 and the lower inwardly-concave strips 13, but also enables the upper inwardly-concave strips 12 and the lower inwardly-concave strips 13 to have certain elasticity, and thus insertion into the upper anti-twist grooves 233 and the lower anti-twist grooves 234 is facilitated.

As shown in FIG. 5 and FIG. 6, preferably, there are two upper anti-twist grooves 233, and the upper anti-twist grooves 233 are disposed side by side in a left-right direction. Preferably, there are also two lower anti-twist grooves 234, and the lower anti-twist grooves 234 are formed side by side in a left-right direction.

It is learned that insertion connection reliability of the electrical connector receptacle and the electrical connector plug has a significant impact on a signal transmission process. In view of this, as shown in FIG. 5 and FIG. 6, the socket tongue 2 further includes a left locking plate 24 and a right locking plate 25. The left locking plate 24 and the right locking plate 25 are both built in and fixed into the insulating plastic body 23 and are opposite to each other in a left-right direction. A left slot is formed by extending rightwards from a left side wall of the left locking plate 24. A left avoidance notch 235 is formed in the left side wall of the insulating plastic body 23 right corresponding to the position of the left slot to expose the left slot. A right slot is formed by extending leftwards from a right side wall of the right locking plate 25. A right avoidance notch 236 is formed in the right side wall of the insulating plastic body 23 right corresponding to the position of the right slot to expose the right slot. Thus, when the electrical connector plug is inserted into the electrical connector receptacle, elastic hook members disposed on two sides of the insulating plastic body of the electrical connector plug slide along two side walls of the socket tongue 2 all the time until entering the left exposed slot and the right exposed slot in a one-to-one correspondence manner, and therefore reliable connection between the electrical connector receptacle and the electrical connector plug matched with the electrical connector receptacle is implemented.

Figure 18:
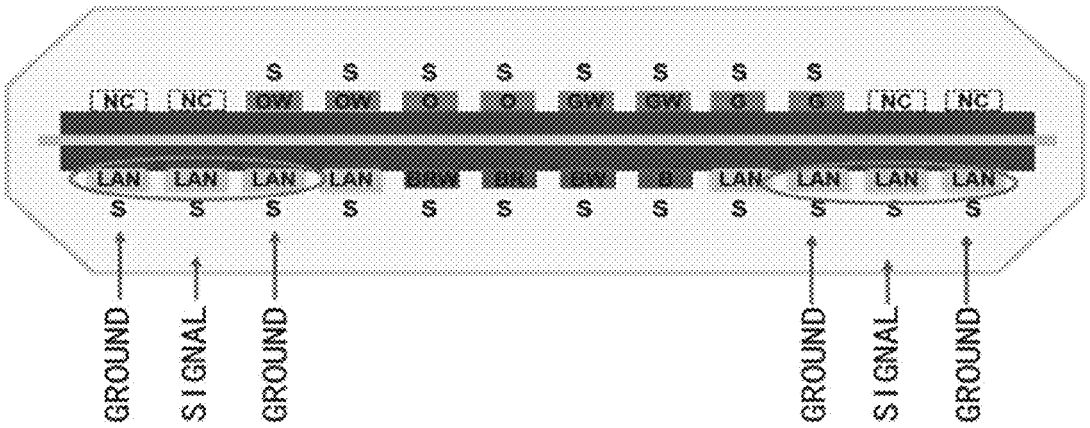
Figure 1:
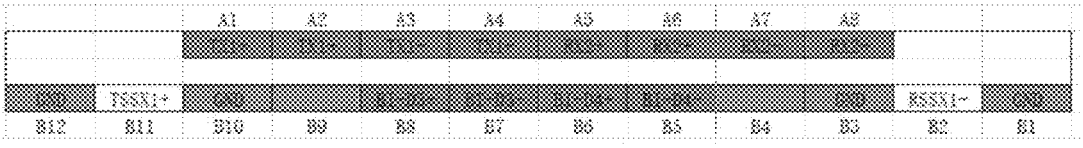
Figures 2, 18, 19:
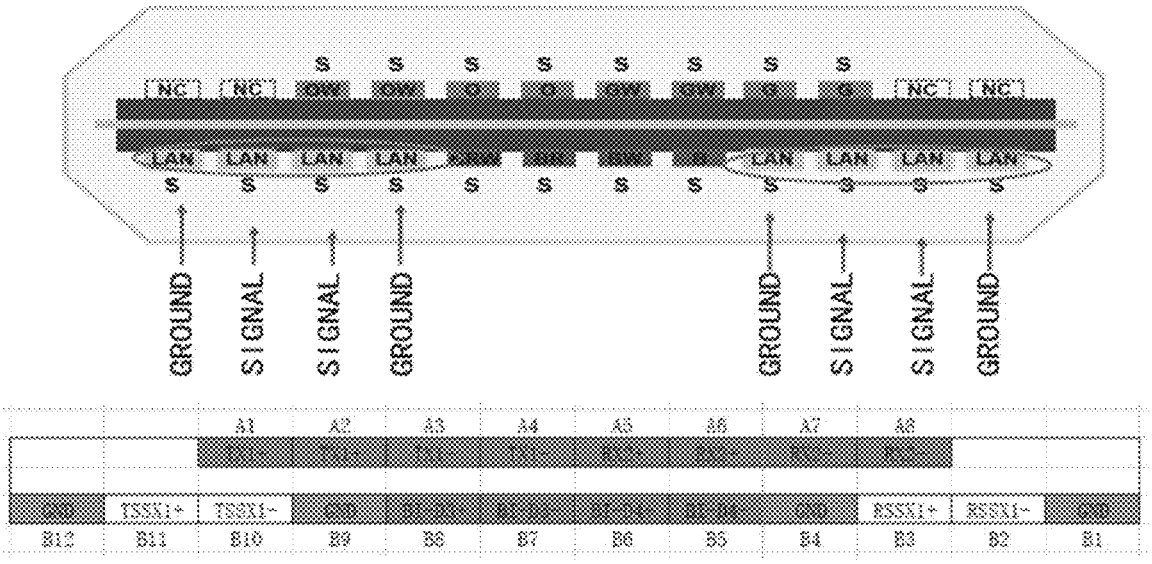
Figure 20:
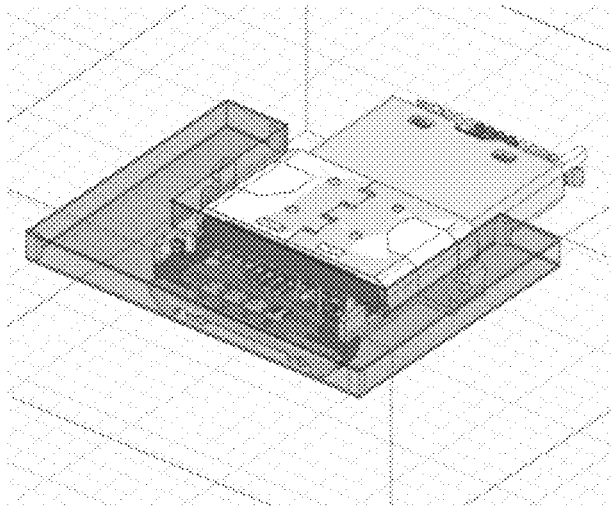
FIG. 20 is a diagram illustrating a state of Ethernet performance in Ansoft software for a high-current high-frequency electrical connector receptacle applicable to network data transmission in the present disclosure.
Figure 21:
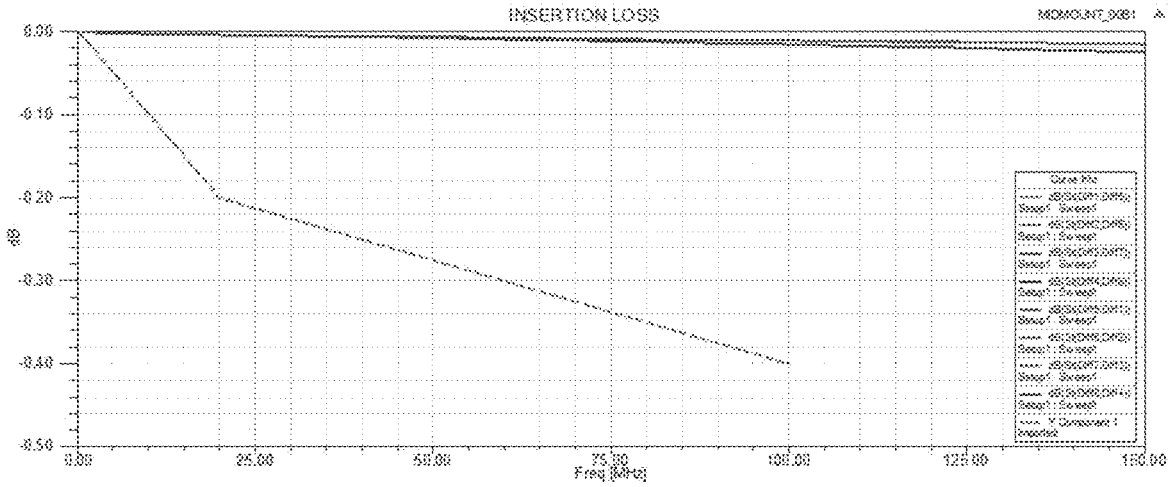
FIG. 21 is a field plot illustrating insertion loss in an Ethernet performance test for a high-current high-frequency electrical connector receptacle applicable to network data transmission in the present disclosure.
Figure 22:
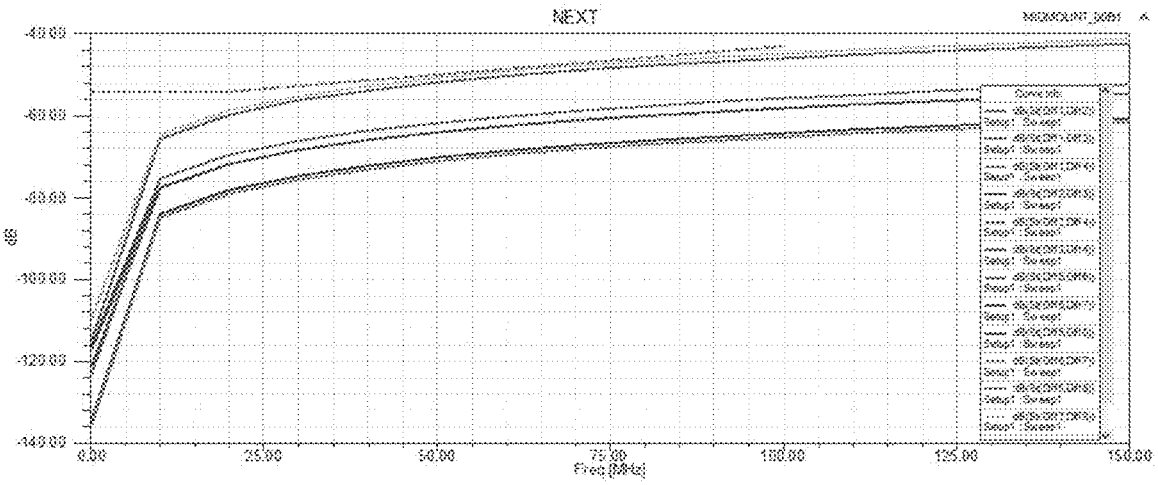
FIG. 22 is a field plot illustrating NEXT (Near end crosstalk) in an Ethernet performance test for a high-current high-frequency electrical connector receptacle applicable to network data transmission in the present disclosure.
Figure 23:
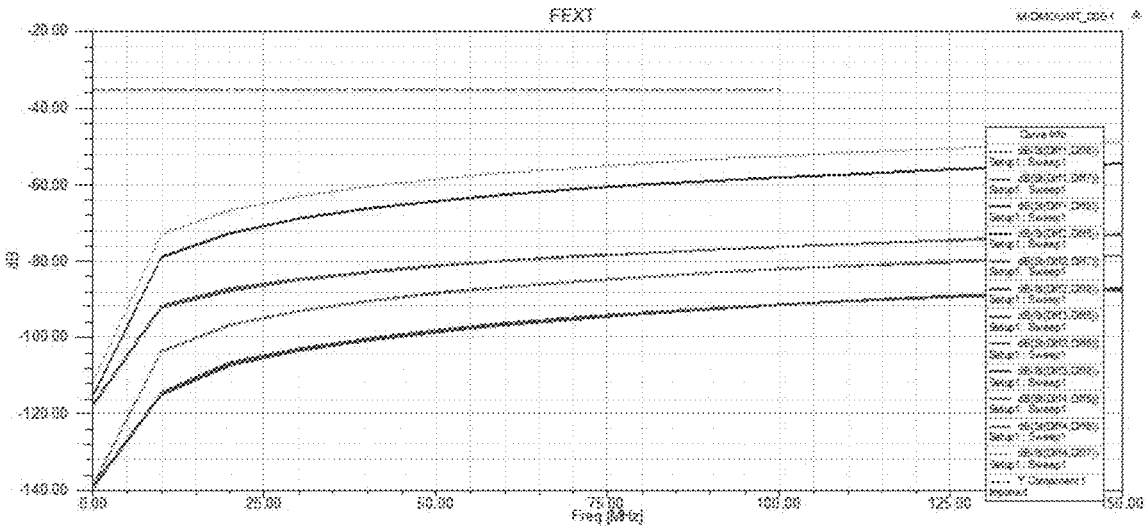
FIG. 23 is a field plot illustrating FEXT (Far end crosstalk) in an Ethernet performance test for a high-current high-frequency electrical connector receptacle applicable to network data transmission in the present disclosure.
Figures 24, 25:
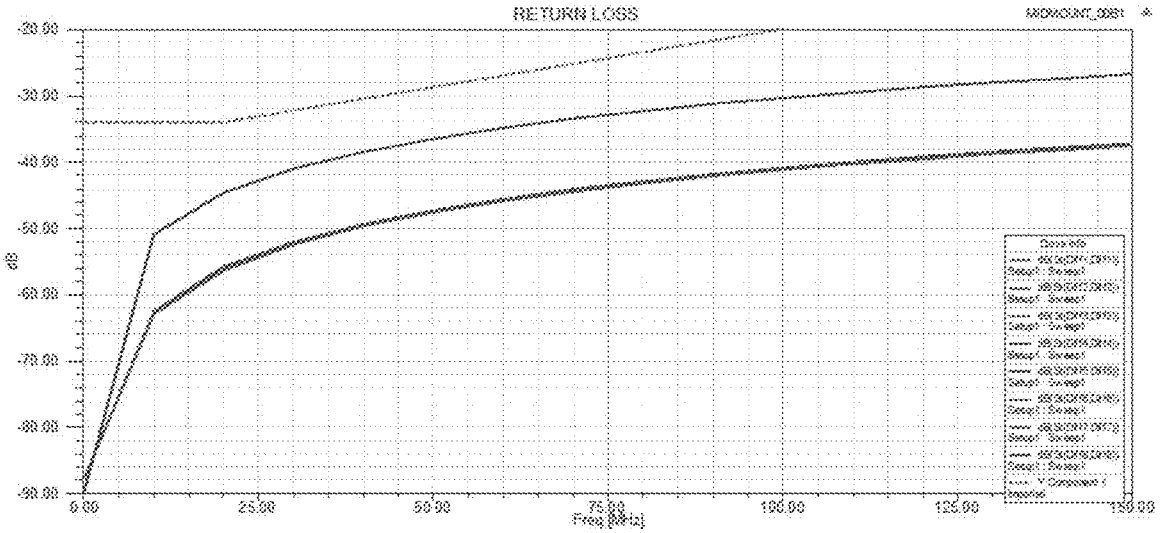
FIG. 24 is a field plot illustrating return loss in an Ethernet performance test for a high-current high-frequency electrical connector receptacle applicable to network data transmission in the present disclosure.
FIG. 25 is a summary list of an Ethernet performance test project for a high-current high-frequency electrical connector receptacle applicable to network data transmission in the present disclosure.
Figure 26:
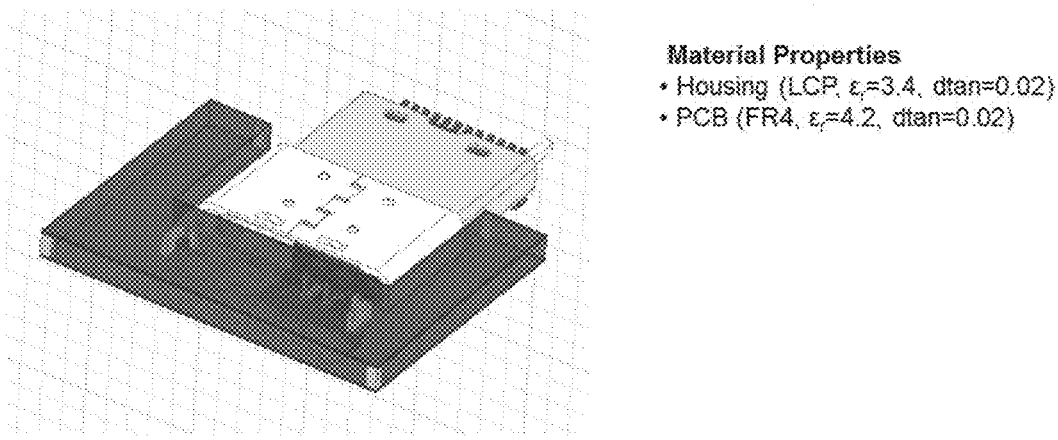
FIG. 26 is a diagram illustrating a state of Ethernet performance in Ansoft software for a high-current high-frequency electrical connector receptacle applicable to network data transmission in the present disclosure.
Figure 27:
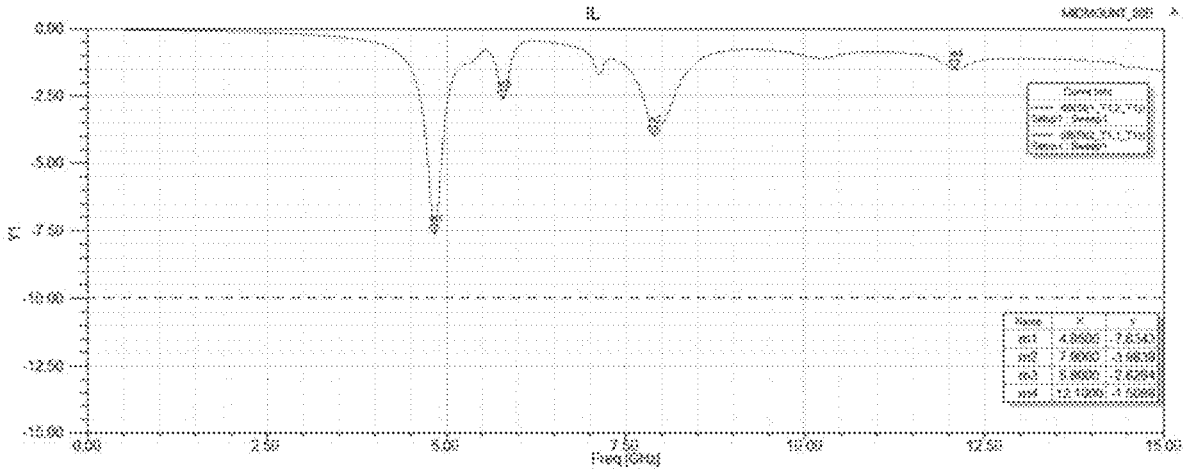
FIG. 27 is a field plot illustrating insertion loss in an Ethernet performance test for a high-current high-frequency electrical connector receptacle applicable to network data transmission in the present disclosure.
Figure 28:
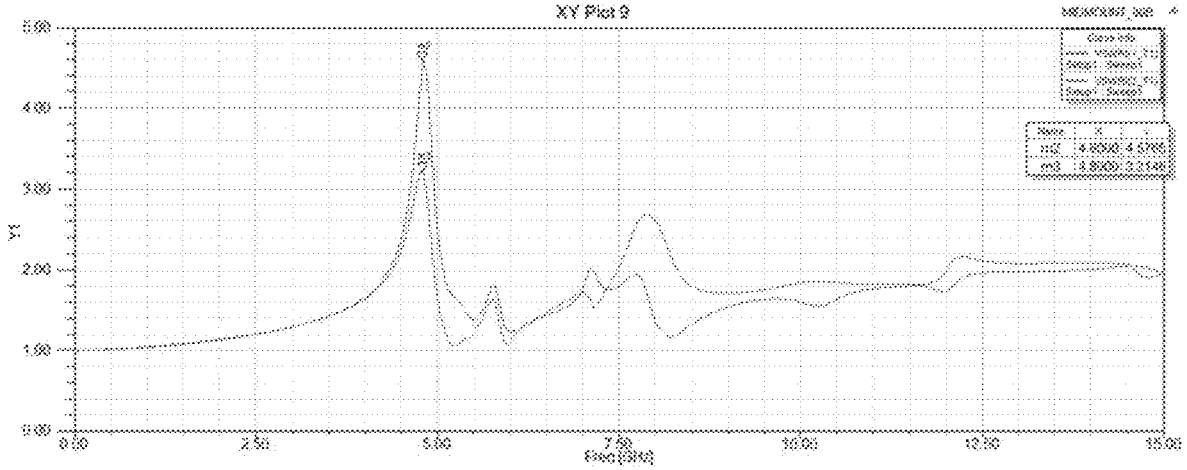
FIG. 28 is a field plot illustrating VSWR (Voltage Standing Wave Ratio) in an Ethernet performance test for a high-current high-frequency electrical connector receptacle applicable to network data transmission in the present disclosure.
Figure 29:
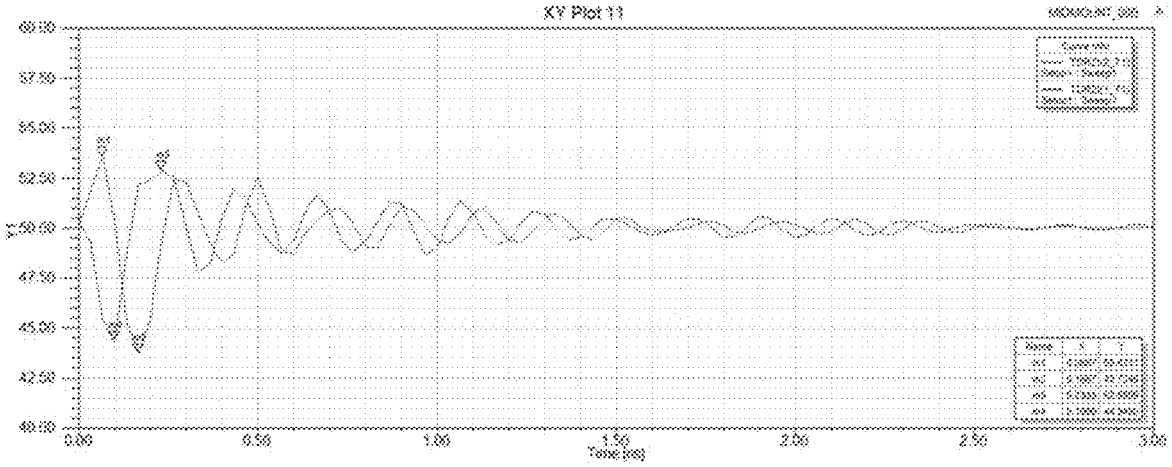
FIG. 29 is a field plot illustrating impedance in an Ethernet performance test for a high-current high-frequency electrical connector receptacle applicable to network data transmission in the present disclosure.
Figure 30:
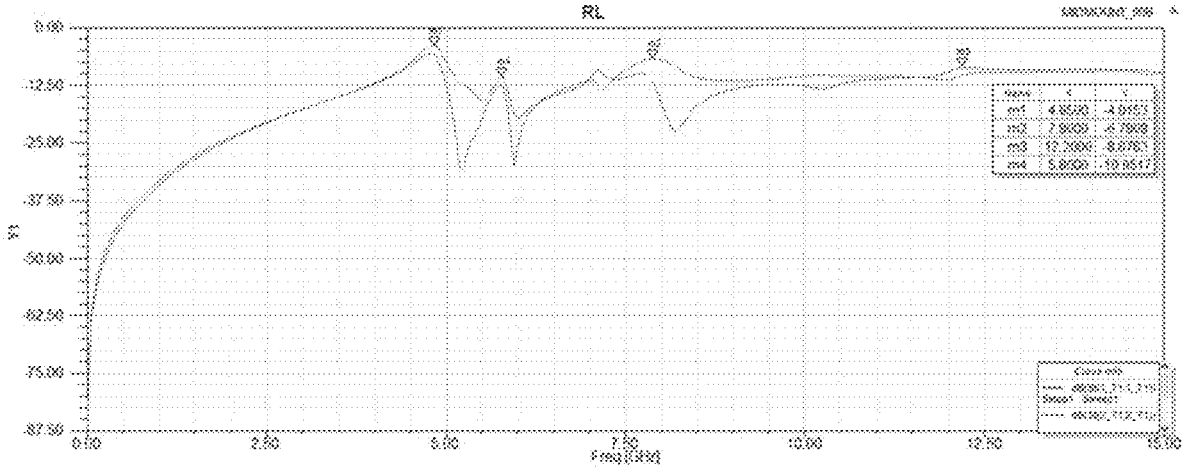
FIG. 30 is a field plot illustrating return loss in an Ethernet performance test for a high-current high-frequency electrical connector receptacle applicable to network data transmission in the present disclosure.

Finally, it should be further noted that to make the high-current high-frequency electrical connector receptacle applicable to network data transmission have two different signal transmission modes, the number of contact terminals included in the upper terminal block 21 and the number of contact terminals included in the lower terminal block 22 are further different in accordance with the requirements of code for design of signal terminals. A high-current transmission function of the electrical connector receptacle may be realized while Ethernet communication is implemented by configuring a PIN through a PoE protocol, and meanwhile transmittable 15G (single-terminal)-20 G (differential) high-frequency data signals are set up by configuring a single high-speed signal pair. FIG. 18-1 shows a Pin definition form in a long-distance 15 G single-terminal signal transmission state for a high-current high-frequency electrical connector receptacle applicable to network data transmission in a normal application state in the present disclosure. FIG. 18-2 shows a Pin definition form in a long-distance 20 G differential signal transmission state for a high-current high-frequency electrical connector receptacle applicable to network data transmission in a normal application state in the present disclosure.

In FIG. 18-1, the upper terminal block comprises two pairs of transmitting differential pins and two pairs of receiving differential pins, wherein each pair of transmitting differential pins is used for sending data to external electronic components unidirectionally, and each pair of transmitting differential pins comprises one TX1+ pin and one TX1− pin. In one aspect, each pair of receiving differential pins is used for receiving data from external electronic components unidirectionally. Each pair of receiving differential pins comprises one RX2+ pin and one RX2− pin; wherein the TX1+ pins are positive phase of data differential pins. In one aspect, the TX1+ pins comprise an A1 pin and an A2 pin; wherein the TX1− pins are negative phase of data differential pins, and the TX1− pins comprise A3 pin and A4 pin. The RX2+ pins are positive phase of data differential pins, and the RX2+ pins comprise an A5 pin and an A6 pin; wherein the RX2− pins are negative phase of data differential pins. The RX2− pins comprise an A7 pin and an A8 pin; wherein the lower terminal block comprises a superspeed transmitting pin, a superspeed receiving pin, two pairs of bi-directional differential pins, a ground unit and an inactivated unit. In one aspect, the superspeed transmitting pin is used for transmitting data to external electronic components unidirectionally; and the superspeed receiving pins are used for receiving data from external electronic components unidirectionally. In one embodiment, each bi-directional differential pin is used for transmitting data to external electronic components or receiving data from external electronic components. The superspeed transmitting pin is a positive phase of data pin and the superspeed transmitting pin is a TSSX1+ pin. and wherein the TSSX1+ pin is a B11 pin. The superspeed receiving pin is a negative phase of the data pin and the superspeed receiving pin is RSSX1+ pin. The RSSX1+ pin may be a B2 pin. In one aspect, a pair of bi-directional differential pins comprises a BI-D3+ pin and a BI-D3− pin. The BI-D3+ pin is a positive phase of data pin and the BI-D3+ pin is a B8 pin. The BI-D3− pin is a negative phase of data pin and the BI-D3 pin is a B7 pin. In one aspect, another pair of bi-directional differential pins comprises a BI-D4+ pin and a BI-D4− pin. The BI-D4+ pin is a positive phase of data pin and the BI-D4+ pin is a B6 pint. The BI-D4− pin is a negative phase of data pin and the BI-D4 pin is a B5 pin. In one aspect, the ground unit comprises a B1 pin, a B3 pin, a B10 pin and a B12 pin; wherein the inactivated unit comprises B4 and B9 pins.

In FIG. 18-2, the upper terminal block comprises two pairs of transmitting differential pins and two pairs of receiving differential pins, wherein each pair of transmitting differential pins is used for sending data to external electronic components unidirectionally, and each pair of transmitting differential pins comprises one TX1+ pin and one TX1− pin; each pair of receiving differential pins is used for receiving data from external electronic components unidirectionally, and each pair of receiving differential pins comprises one RX2+ pin and one RX2− pin; wherein the TX1+ pins are positive phase of data differential pins, and the TX1+ pins comprise A1 pin and A2 pin; wherein the TX1− pins are negative phase of data differential pins, and the TX1− pins comprise A3 pin and A4 pin; wherein the RX2+ pins are positive phase of data differential pins, and the RX2+ pins comprise A5 pin and A6 pin; wherein the RX2− pins are negative phase of data differential pins, and the RX2− pins comprise A7 pin and A8 pin; wherein the lower terminal block comprises a pair of superspeed differential transmitting pins, a pair of superspeed differential receiving pins, two pairs of bi-directional differential pins and a ground unit; wherein the superspeed differential transmitting pins are used for transmitting data to external electronic components unidirectionally; wherein the superspeed differential receiving pins are used for receiving data from external electronic components unidirectionally; wherein each bi-directional differential pin is used for transmitting data to external electronic components or receiving data from external electronic components; wherein the superspeed differential transmitting pins comprise TSSX1+ pin and TSSX1− pin; wherein the TSSX1+ pin is positive phase of data differential pin, and the TSSX1+ pin is B11 pin; wherein the TSSX1− pin is negative phase of data differential pin, and the TSSX1− pin is B10 pin; wherein the superspeed differential receiving pins comprise RSSX1+ pin and RSSX1− pin; wherein the RSSX1+ pin is positive phase of data differential pin, and the RSSX1+ pin is B3 pin; wherein the RSSX1− pin is negative phase of data differential pin, and the RSSX1− pin is B2 pin; wherein a pair of bi-directional differential pins comprises BI-D3+ pin and BI-D3− pin, the BI-D3+ pin is positive phase of data pin and the BI-D3+ pin is B8 pin; the BI-D3− pin is negative phase of data pin and the BI-D3 pin is B7 pin; wherein another pair of bi-directional differential pins comprises BI-D4+ pin and Bi-D4− pin, the BI-D4+ pin is positive phase of data pin and the BI-D4+ pin is B6 pin; the BI-D4− pin is negative phase of data pin and the BI-D4 pin is B5 pin; wherein the ground unit comprises B1 pin, B4 pin, B9 pin and B12 pin;

FIG. 19 to FIG. 24 are plots illustrating results of an Ethernet performance test for a high-current high-frequency electrical connector receptacle applicable to network data transmission in the present disclosure.

FIG. 25 to FIG. 30 are plots illustrating results of a high-speed transmission performance test for a high-current high-frequency electrical connector receptacle applicable to network data transmission in the present disclosure.

Due to the above description of the disclosed embodiments, those skilled in the art may implement or use the present disclosure. Various modifications to these embodiments are readily apparent to those skilled in the art, and the general principles defined herein may be implemented in other embodiments without departing from the gist or scope of the present disclosure. Therefore, the present disclosure is not limited to the embodiments shown herein but falls within the widest scope consistent with the principles and novel features disclosed herein.

What is claimed is:

1. A high-current high-frequency electrical connector receptacle applicable to network data transmission, comprising:

a receptacle housing, provided with a first special-shaped fool-proofing unit; and a socket tongue, configured to be inserted and locked into the receptacle housing, the socket tongue comprising an upper terminal block, a lower terminal block and an insulating plastic body, and the upper terminal block and the lower terminal block each being built in and fixed into the insulating plastic body;

wherein the upper terminal block comprises two pairs of transmitting differential pins and two pairs of receiving differential pins, wherein each pair of transmitting differential pins is used for sending data to one or more external electronic components unidirectionally, and each pair of transmitting differential pins comprises one TX1+ pin and one TX1− pin;

each pair of receiving differential pins is used for receiving data from one or more external electronic components unidirectionally, and each pair of receiving differential pins comprises one RX2+ pin and one RX2− pin;

wherein the TX1+ pins are positive phase of data differential pins, and the TX1+ pins comprise an A1 pin and an A2 pin;

wherein the TX1− pins are negative phase of data differential pins, and the TX1− pins comprise an A3 pin and an A4 pin;

wherein the RX2+ pins are positive phase of data differential pins, and the RX2+ pins comprise an A5 pin and an A6 pin;

wherein the RX2− pins are negative phase of data differential pins, and the RX2− pins comprise an A7 pin and an A8 pin;

wherein the lower terminal block comprises a pair of superspeed differential transmitting pins, a pair of superspeed differential receiving pins, two pairs of bi-directional differential pins and a ground unit;

wherein the superspeed differential transmitting pins are used for transmitting data to one or more external electronic components unidirectionally;

wherein the superspeed differential receiving pins are used for receiving data from one or more external electronic components unidirectionally;

wherein each bi-directional differential pin is used for transmitting data to one or more external electronic components or receiving data from one or more external electronic components;

wherein the superspeed differential transmitting pins comprise a TSSX1+ pin and a TSSX1− pin;

wherein the TSSX1+ pin is a positive phase of data differential pin, and the TSSX1+ pin is a B11 pin;

wherein the TSSX1− pin is negative phase of data differential pin, and the TSSX1− pin is a B10 pin;

wherein the superspeed differential receiving pins comprise an RSSX1+ pin and an RSSX1− pin;

wherein the RSSX1+ pin is a positive phase of data differential pin, and the RSSX1+ pin is a B3 pin;

wherein the RSSX1− pin is a negative phase of data differential pin, and the RSSX1− pin is a B2 pin;

wherein a pair of bi-directional differential pins comprises a BI-D3+ pin and a BI-D3− pin, the BI-D3+ pin is a positive phase of data pin and the BI-D3+ pin is a B8 pin; the BI-D3− pin is a negative phase of data pin and the BI-D3− pin is a B7 pin;

wherein another pair of bi-directional differential pins comprises a BI-D4+ pin and a Bi-D4− pin, the BI-D4+ pin is a positive phase of data pin and the BI-D4+ pin is a B6 pin; the BI-D4− pin is a negative phase of data pin and the BI-D4 pin is a B5 pin;

wherein the ground unit comprises a B1 pin, a B4 pin, a B9 pin and a B12 pin;

wherein a second special-shaped fool-proofing unit is disposed on the insulating plastic body;

wherein the second special-shaped fool-proofing unit comprises a left fool-proofing protruding strip and a right fool-proofing protruding strip, and the left fool-proofing protruding strip and the right fool-proofing protruding strip are both formed by extending upwardly from a top wall of the insulating plastic body.

2. The electrical connector receptacle according to claim 1, wherein the first special-shaped fool-proofing unit comprises a left chamfered part, and the left chamfered part is formed by chamfering of a left side wall and a top wall of the receptacle housing.

3. The electrical connector receptacle according to claim 2, wherein the first special-shaped fool-proofing unit further comprises a right chamfered part mirrored to the left chamfered part, and the right chamfered part is formed by chamfering of a right side wall and the top wall of the receptacle housing.

4. The electrical connector receptacle according to claim 1, wherein the insulating plastic body comprises a transverse limiting protruding strip formed by extending from at least one of the top wall and a bottom wall of the insulating plastic body and configured to limit a depth by which the socket tongue is inserted into the receptacle housing.

5. The electrical connector receptacle according to claim 1, wherein the insulating plastic body comprises at least one upper anti-twist groove formed in a top wall of the insulating plastic body, and at least one lower anti-twist groove formed in a bottom wall of the insulating plastic body, and the receptacle housing comprises at least one upper inwardly-concave strip formed in a top wall of the receptacle housing and inserted into the at least one upper anti-twist groove, and at least one lower inwardly-concave strip formed in a bottom wall of the receptacle housing and inserted into the at least lower anti-twist groove.

6. The electrical connector receptacle according to claim 5, wherein each of the at least one upper inwardly-concave strip and the at least one lower inwardly-concave strip is inserted into a respective one of the at least one upper anti-twist groove and the at least one lower anti-twist groove in a clearance fit manner with a single-side clearance controlled in the range of 0.1 mm to 0.2 mm.

7. The electrical connector receptacle according to claim 5, wherein the at least one upper inwardly-concave strip is formed by direct downward drawing from the top wall of the receptacle housing, and the at least one lower inwardly-concave strip is formed by direct upward drawing from the bottom wall of the receptacle housing.

8. The electrical connector receptacle according to claim 5, wherein the at least one upper anti-twist groove comprise two upper anti-twist grooves disposed side by side, and the at least one lower anti-twist groove comprise two lower anti-twist grooves disposed side by side.

9. The electrical connector receptacle according to claim 1, wherein the socket tongue further comprises a left locking plate and a right locking plate; the left locking plate and the right locking plate are both built in and fixed into the insulating plastic body; the left locking plate comprises a left slot extending rightwards from a left side wall of the left locking plate, and the insulating plastic body comprises a left avoidance notch disposed on a left side wall of the insulating plastic body to expose the left slot; and the right locking plate comprises a right slot extending leftwards from a right side wall of the right locking plate, and the insulating plastic body comprises a right avoidance notch disposed on a right side wall of the insulating plastic body to expose the right slot.

10. A high-current high-frequency electrical connector receptacle applicable to network data transmission, comprising:

a receptacle housing, provided with a first special-shaped fool-proofing unit; and a socket tongue, configured to be inserted and locked into the receptacle housing, the socket tongue comprising an upper terminal block, a lower terminal block and an insulating plastic body, and the upper terminal block and the lower terminal block each being built in and fixed into the insulating plastic body;

wherein the upper terminal block comprises two pairs of transmitting differential pins and two pairs of receiving differential pins, wherein each pair of transmitting differential pins is used for sending data to one or more external electronic components unidirectionally, and each pair of transmitting differential pins comprises one TX1+ pin and one TX1− pin;

each pair of receiving differential pins is used for receiving data from one or more external electronic components unidirectionally, and each pair of receiving differential pins comprises one RX2+ pin and one RX2− pin;

wherein the TX1+ pins are positive phase of data differential pins, and the TX1+ pins comprise an A1 pin and an A2 pin;

wherein the TX1− pins are negative phase of data differential pins, and the TX1− pins comprise an A3 pin and an A4 pin;

wherein the RX2+ pins are positive phase of data differential pins, and the RX2+ pins comprise an A5 pin and an A6 pin;

wherein the RX2− pins are negative phase of data differential pins, and the RX2− pins comprise an A7 pin and an A8 pin;

wherein the lower terminal block comprises a superspeed transmitting pin, a superspeed receiving pin, two pairs of bi-directional differential pins, a ground unit and an inactivated unit;

wherein the superspeed transmitting pin is used for transmitting data to one or more external electronic components unidirectionally;

wherein the superspeed receiving pins is used for receiving data from one or more external electronic components unidirectionally;

wherein each bi-directional differential pin is used for transmitting data to one or more external electronic components or receiving data from one or more external electronic components;

wherein the superspeed transmitting pin is a positive phase of data pin and the superspeed transmitting pin is a TSSX1+ pin; and wherein the TSSX1+ pin is a B11 pin;

wherein the superspeed receiving pin is a negative phase of data pin and the superspeed receiving pin is an RSSX1+ pin; and wherein the RSSX1+ pin is a B2 pin;

wherein a pair of bi-directional differential pins comprises a BI-D3+ pin and a BI-D3− pin, the BI-D3+ pin is a positive phase of data pin and the BI-D3+ pin is a B8 pin; the BI-D3− pin is a negative phase of data pin and the BI-D3− pin is a B7 pin;

wherein another pair of bi-directional differential pins comprises a BI-D4+ pin and a Bi-D4− pin, the BI-D4+ pin is a positive phase of data pin and the BI-D4+ pin is a B6 pin; the BI-D4− pin is a negative phase of data pin and the BI-D4 pin is a B5 pin;

wherein the ground unit comprises a B1 pin, a B3 pin, a B10 pin and a B12 pin;

wherein the inactivated unit comprises B4 and B9 pins;

wherein a second special-shaped fool-proofing unit is disposed on the insulating plastic body;

wherein the second special-shaped fool-proofing unit comprises a left fool-proofing protruding strip and a right fool-proofing protruding strip, and the left fool-proofing protruding strip and the right fool-proofing protruding strip are both formed by extending upwardly from a top wall of the insulating plastic body.

* * * * *